United States Patent [19]

Down et al.

[11] 4,019,427

[45] Apr. 26, 1977

[54] PARTITION ASSEMBLER

[75] Inventors: Alfred G. Down, Wood Dale, Ill.; Robert L. Nebeling, Wayne, N.J.

[73] Assignee: Continental Can Company, Inc., New York, N.Y.

[22] Filed: Dec. 1, 1975

[21] Appl. No.: 636,568

Related U.S. Application Data

[63] Continuation of Ser. No. 228,559, Feb. 28, 1972, abandoned.

[52] U.S. Cl. ..... 93/37 R; 93/36 R

[51] Int. Cl.[2] ..... B31D 3/04

[58] Field of Search ..... 93/37 R, 37 EC, 37 SP, 93/38, 36 R; 214/8.5 F

[56] References Cited

UNITED STATES PATENTS

| | | | |
|---|---|---|---|
| 2,742,827 | 4/1956 | Schroeder | 93/37 R |
| 2,860,554 | 11/1958 | Shields | 93/37 R |
| 3,133,481 | 5/1964 | McCormick et al. | 93/37 R |
| 3,225,665 | 12/1965 | Lovett et al. | 93/37 R |
| 3,626,818 | 12/1971 | Anson | 93/37 R |
| 3,685,401 | 8/1972 | Peters | 93/37 R |
| 3,777,630 | 12/1973 | Roda | 93/37 R |

*Primary Examiner*—James F. Coan

*Attorney, Agent, or Firm*—Diller, Brown, Ramik & Wight

[57] ABSTRACT

This disclosure relates to a machine for assembling partition pieces of corrugated board or similar material to form partitions therefrom, and includes means for feeding partition pieces toward conveying means and into guide means with means for shifting different ones of the guide means into alignment with the partition pieces whereby individual partition pieces from a single feed means are disposed in at least two different ones of the guide means. The conveying means include a plurality of spaced endless members with flight bars being united therebetween by quick disconnect coupling means and means for shifting the flight bars relative to each other to vary the spacing therebetween in the direction of conveyor travel. The machine further includes hoppers having bottom and upstanding walls at respective acute and obtuse angles to the horizontal whereby partition pieces are maintained in upright stacked relationship and are movable under gravity influence toward the upstanding walls.

28 Claims, 23 Drawing Figures

PARTITION ASSEMBLER

The present invention constitutes a continuation of commonly assigned application Ser. No. 228,559 filed Feb. 28, 1972, which is now abandoned.

Conventional partition assembling machines normally include a conveyor for advancing partition pieces along a horizontal path along which are disposed a number of hoppers provided with feed means for feeding partition pieces between guide wires running the length of the assembling area. The conveyor moves these pieces in unison toward another hopper which transversely spans the conveyor and is provided with means for feeding other partition pieces downwardly to engage the various partition pieces in crossed relationship to complete each partition or partition assembly.

Though partition assembly machines of such conventional constructions are for the most part satisfactory, it is obviously advantageous from a commercial standpoint to facilitate overall machine efficiency by increasing efficiency and reducing down-time and/or changeover time and the unit cost per partition can be reduced thus not only providing a competitive advantage but a cost saving to the packager which is ultimately in turn reflected as a saving to the eventual consumer.

In keeping with the foregoing the novel partition assembler of the present invention includes a conveyor constructed as a pair of endless members, such as chains entrained about sprockets, which are spanned by a plurality of flight bars which engage trailing edges of the partition pieces and advance the same through the machine. In keeping with this invention quick change coupling means are provided for rapidly securing the flight bars to or removing the flight bars from the endless members and/or changing the spacing therebetween in the machine direction. The quick change means include lateral flanges carried by the endless members which engage a bayonet locking clip at one end of each flight bar while at each flight bar's opposite end is a clamp carrying a one-quarter turn lock screw. Accurate positioning of the flight bars is also achieved by interlocking apertures thereof with locating pins carried by at least one of the endless members. Due to this construction the spacing of the flight bars in the machine direction can be quickly attained by repositioning the flight bars and adding and/or substracting flight bars as necessary. This totally eliminates conventional practice of maintaining a standard 24 inch space between adjacent flight bars in conventional machines and replacing the same spacing ranging between 9 inch–27 inch preferably, though not necessarily, in 3 inch increments. This not only decreases changeover time but inherently greater efficiency of operation is achieved since for a particular length partition piece adjacent flight bars can be positioned closer to each other than the standard conventional 24 inches heretofore noted. For example, if 8 inch partition pieces are fed at a 12 inch spacing between flight bars more partitions per unit length of time can be assembled than if like dimension partition pieces were fed by standardly (24 inches) spaced flight bars.

In conventional partition assemblers each partition piece is individually fed from a stack of partition pieces supported on edge in a hopper which includes a biased or counterbalanced stack pusher. As a hopper approached depletion it was necessary for an operator to remove the pusher, place a new stack of the partition pieces in the hopper and reposition the pusher behind the new stack. Needless to say this operation is not only time consuming but also results in the loss of pressure against the stack during the time that the pusher has been removed causing misfeed and/or jamming.

The latter-noted disadvantages have been eliminated by the present partition assembler wherein both side and cross feed hoppers have bottom and upright walls at respective acute and obtuse angles to the horizontal which prevent the partition pieces from tipping over and avoiding conventional pushers since the stack of partition pieces are gravity influenced toward the upright wall. Moreover, the entire machine is set at a 10° angle of ascent to the horizontal in the machine direction which results in the formation of a compound angle at the side hoppers which performs the twofold function of maintaining the partition pieces moving forward toward the side hopper upstanding walls and also this achieves side positioning or alignment incident to feed. Each hopper additionally includes a vibrator to augment the gravity influence heretofore noted which in conjunction with a vacuum drawn through the upstanding walls of the hopper assures repetitive partition piece feed.

Another and equally important novel feature of this invention is the elimination of the number of feeding stations both at the side and front or transverse feed stations of the machine. For example, in conventional assemblers there might be as many as eight feed stations, six of which being side feed stations and two being front feed stations which require an operator to feed the machine from not only one end but both sides thereof.

Though the present partition assembler still includes a dual front feed for the cross or transverse partition pieces, the number of side feed stations have been halved (only three) by providing each with a novel shuttle which is shifted between strokes of the feed means such that two partition pieces are fed from each side feed station but each is fed into a different guide or channel. Partition pieces can therefore be fed from but a single side of the machine and due to a novel control of the feed mechanism responsive to flight bar position there is no decrease in efficiency even though the number of side feed stations has been halved.

The novel partition assembler of this invention also includes an adjustable feed gate associated with each hopper which provides precision adjustment of the gap through which the partition pieces are fed to achieve maximum reliability. Added efficiency is achieved by disposing the gate adjusting means for both the side feed and cross feed stations at but one side of the machine.

With the above and other objects in view that will hereinafter appear, the nature of the invention will be more clearly understood by reference to the following detailed description, the appended claimed subject matter, and the several views illustrated in the accompanying drawings.

Figure 19:
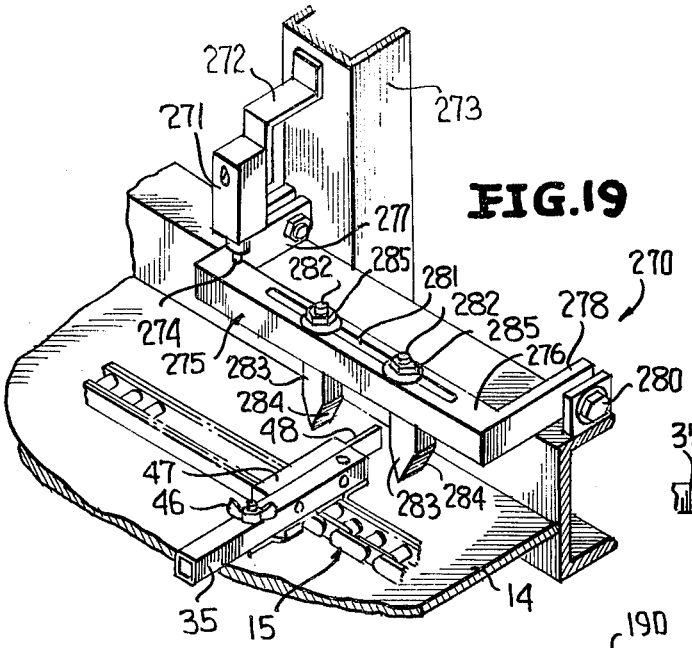
FIG. 19 is a perspective view of the mechanisms of FIGS. 17 and 18, and more clearly illustrates the details thereof.
Figure 18:
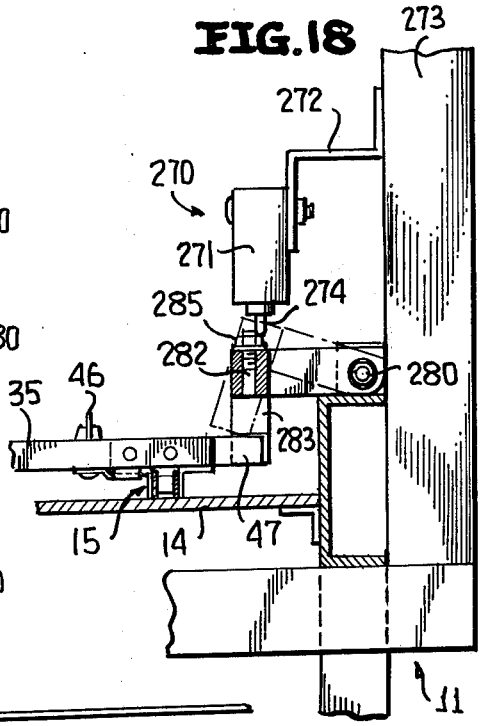
FIG. 18 is a sectional view taken generally along line 18–18 of FIG. 17, and illustrates the manner in which the depending fingers are aligned with the flight bar carried cam for actuation to the phantom outline position thereof.
Figure 23:
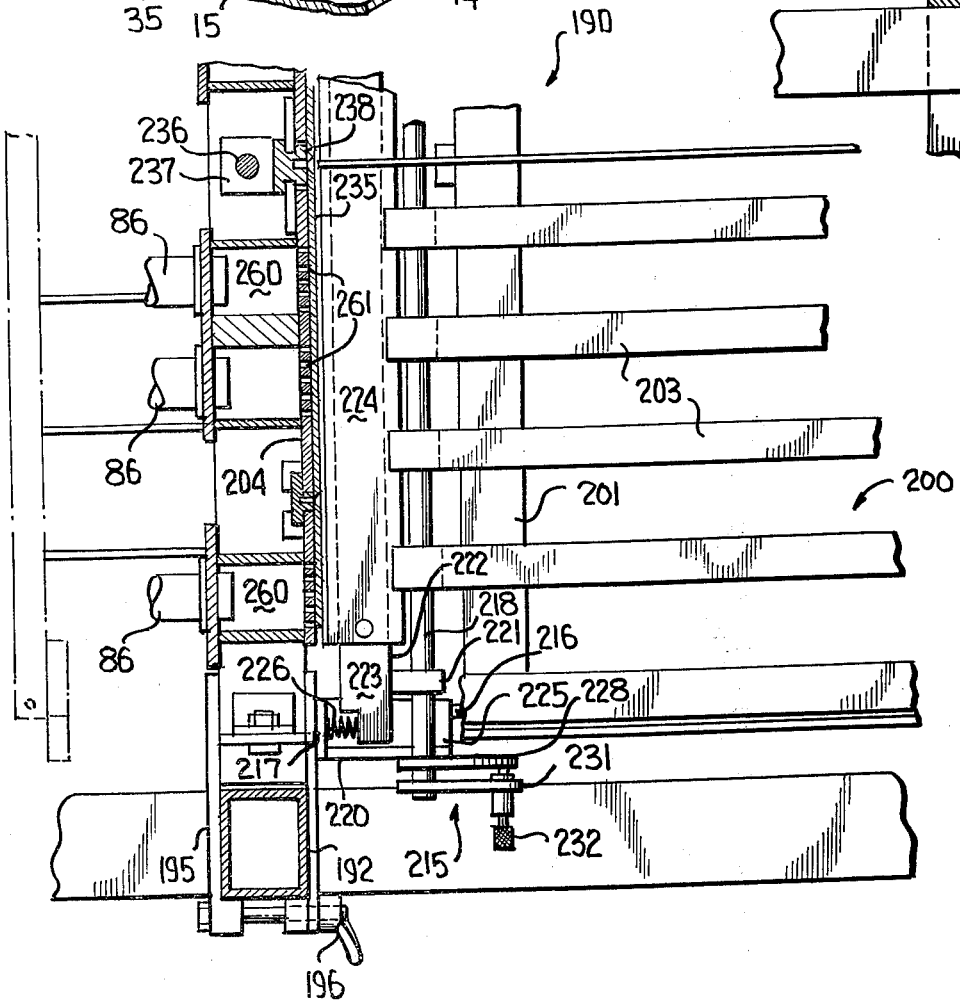
Figure 22:
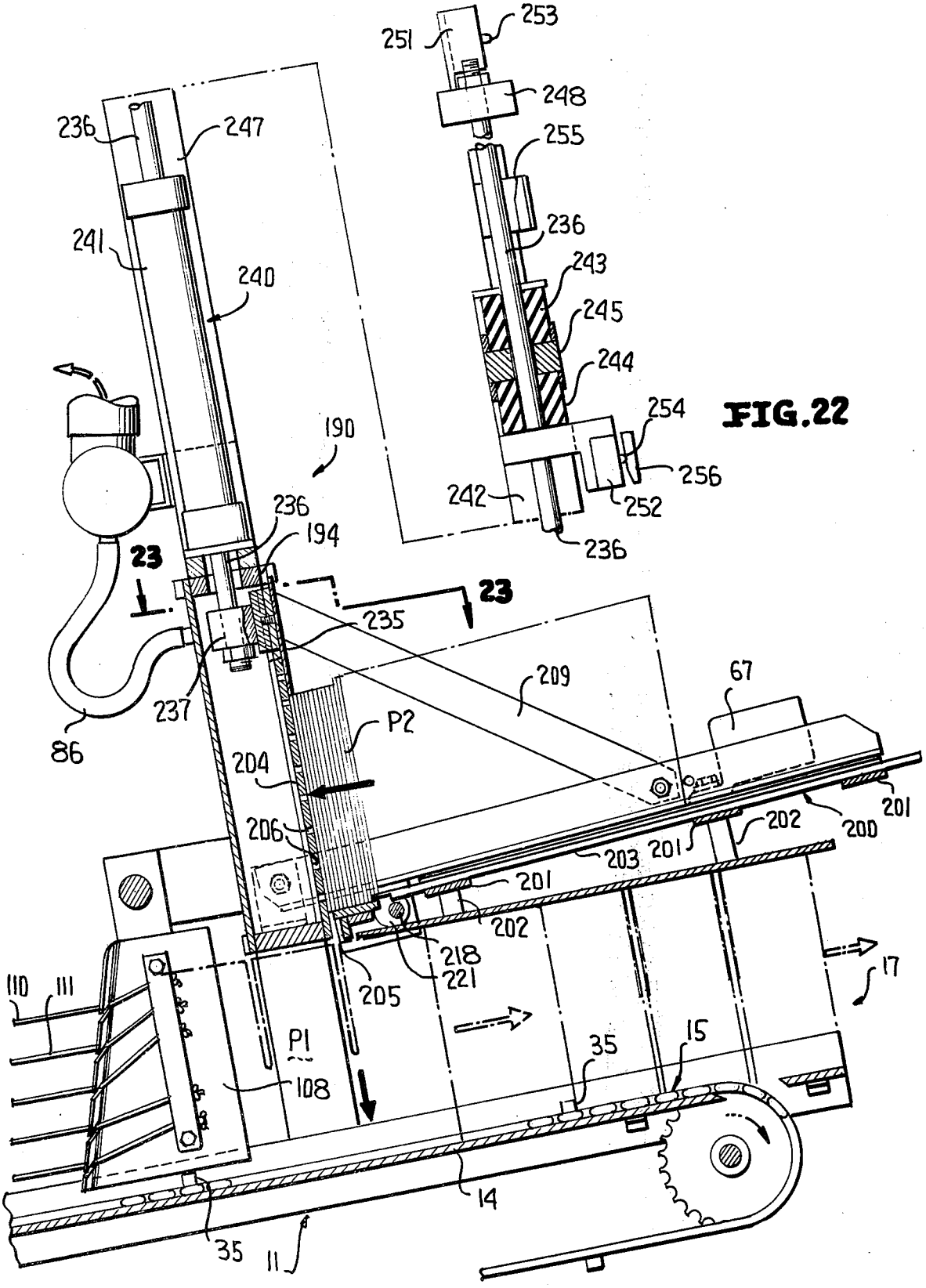
FIG. 22 is a sectional view taken generally along line 22—22 of FIG. 20, and illustrates details of the front feed mechanism.

FIG. 23 appearing on the sheet of drawing containing FIGS. 18 and 19 is a sectional view taken generally along line 23—23 of FIG. 22, and illustrates details of a manifold for drawing a vacuum through an apertured upstanding wall of the front feed mechanism hopper.

Figure 1:
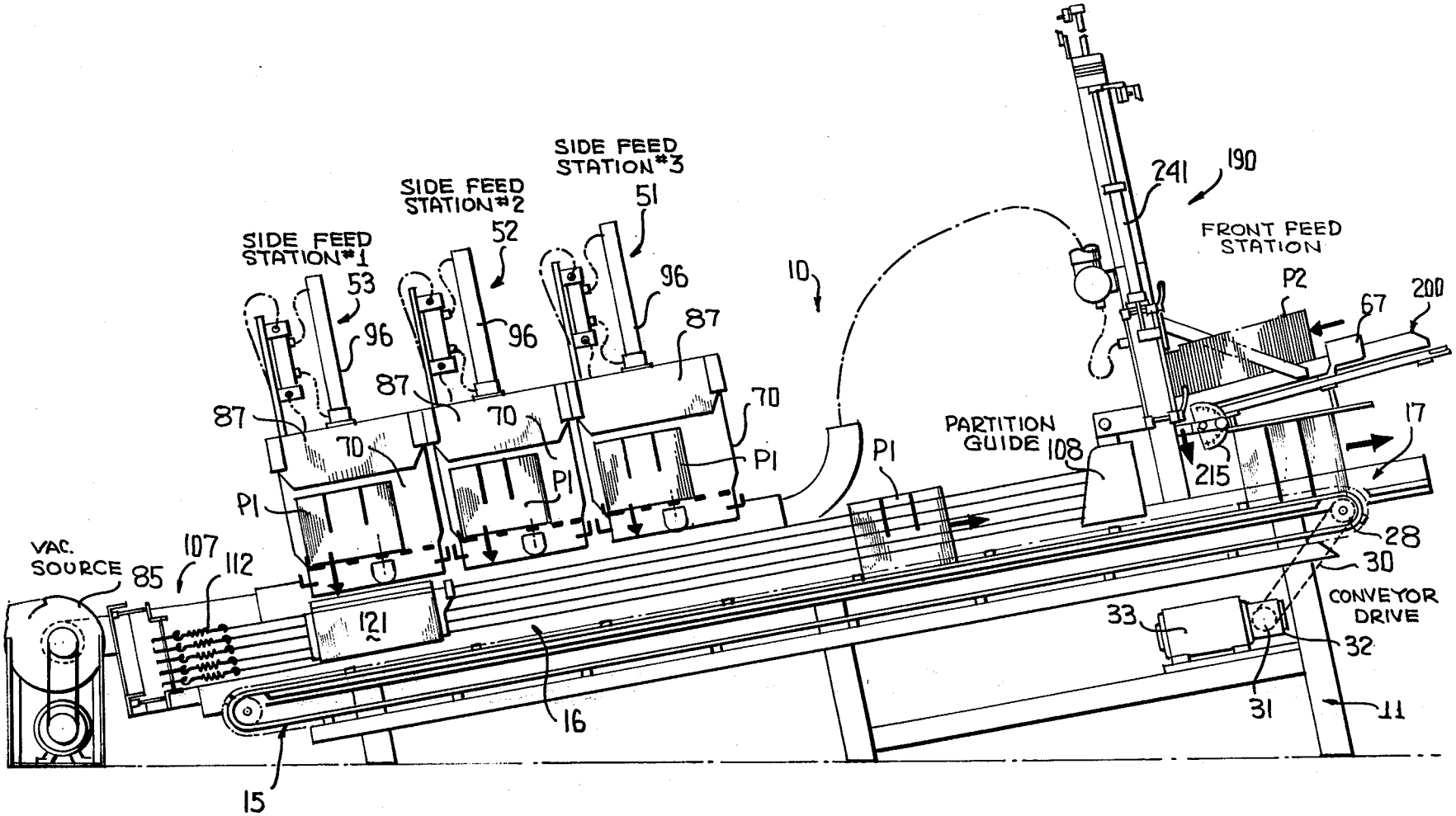
FIG. 1 is a side elevational view of a machine for assembling partitions in keeping with the present invention, and illustrates three side feed mechanisms, a front feed mechanism, and a conveyor having flight bars for advancing partition pieces along guide channels to the front feed mechanism.
Figures 6, 7:
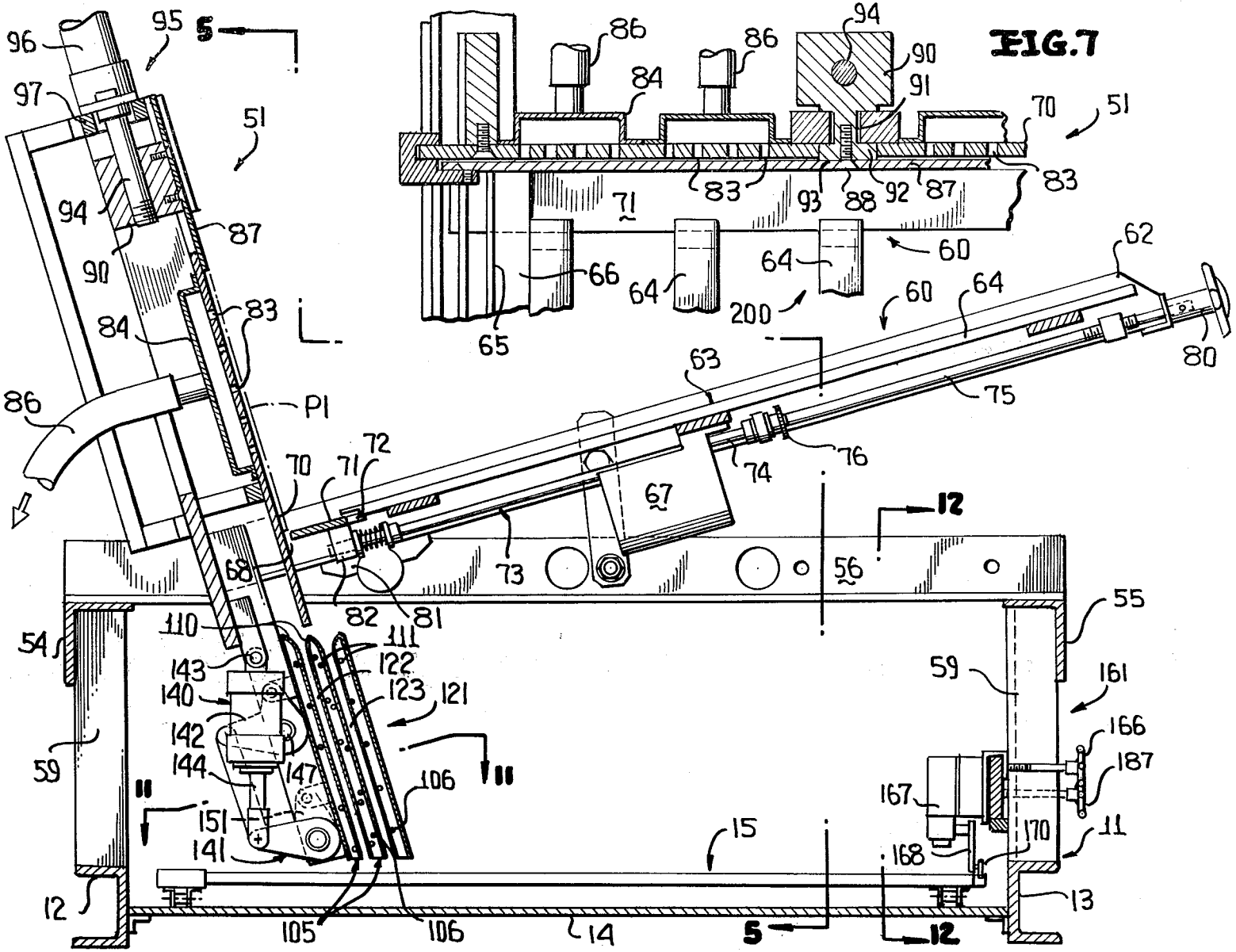
FIG. 6 is a cross-sectional view taken generally along line 6—6 of FIG. 5 and illustrates details of the shuttle and the gate adjusting mechanism.
FIG. 7 is a fragmentary sectional view taken generally along line 7—7 of FIG. 5, and illustrates the manner in which an upstandihg plate of the hopper of the feed mechanism is connected to a vacuum source.

Referring now particularly to FIGS. 1 through 4 of the drawings, a novel machine for assembling partition pieces or similar generally flat, uniplanar blanks is generally designnated by the reference numeral 10 having a frame 11 defined in part by a pair of side rails 12, 13 (FIG. 6). The rails 12, 13 are at an angle of generally 10° to the horizontal, as is a support 14 (FIG. 6) which extends the length of the frame 11 and conveyor means 15 associated therewith having an entrance end portion 16 and an exit end portion 17 (FIG. 1).

Figure 14:
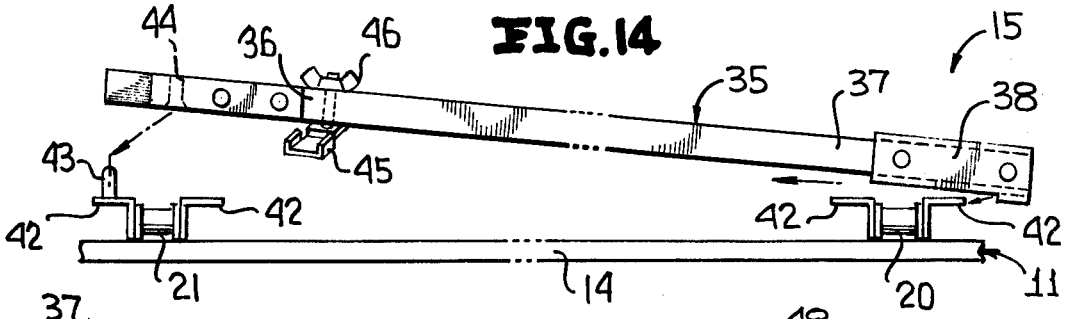
FIG. 14 is a fragmentary elevational view of the conveyor and one of the plurality of flight bars thereof, and illustrates the manner in which a bayonet clip and a one-quarter turn screw clamp at opposite ends of the flight bar permit the same to be readily and rapidly adjusted with respect to the chains of the conveyor.

The conveyor means or conveyor 15 is defined by a pair of endless members 20, 21 (FIGS. 2 and 4) entrained about idler sprockets 22, 23 respectively, keyed to a shaft 24 and about drive sprockets 25, 26 keyed to a shaft 27. The shaft 27 in turn has keyed thereto a sprocket 28 about which is entrained a timing chain 30. The timing chain 30 is entrained about a sprocket 31 forming a portion of a right angle drive 32 of an electric motor 33 connected to a suitable source (not shown) of electrical power. The shafts 24, 27 are suitably journalled for rotation in the frame 11 such that an upper run (unnumbered) of the chains 20, 21 rides upon the upper surface or slightly above the upper surface of the plate 14 (FIG. 6) while the lower run of the chains 20, 21 is located therebeneath. Thus, partition pieces P1 fed in a manner to be described hereinafter upon the upper surface of the plate 14 are conveyed therealong as trailing edges of the partition pieces P1 are contacted by flight bars or pusher bars 35 spanning and coupled to the chains 20, 21 in the manner best illustrated in FIGS. 14 through 16 of the drawings to which attention is now specifically directed.

Figure 15:
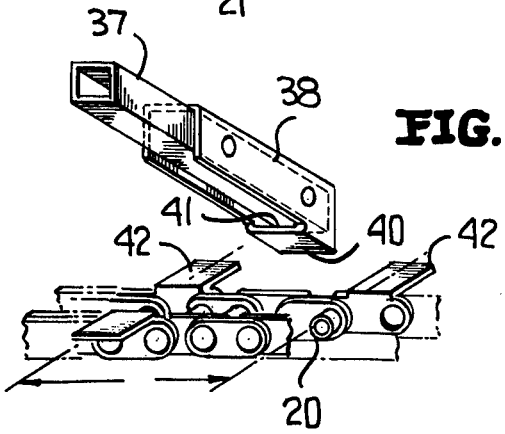
FIG. 15 is a perspective view of the right-hand portion of FIG. 14 and illustrates the manner in which a lateral flange is received in the bayonet clip of the flight bar.

Each flight bar 35 of the conveying means 15 is a tubular rectangular element having opposite ends 36, 37 connected to the respective endless members 21, 20. A generally rectangular sleeve 38 having a major portion of its bottom cut away, as best shown in FIG. 15, is secured by bolts (not shown) to the end portion 37 of each flight bar 35 with the remaining bottom portion 40 of the sleeve 38 defining a slot or recess 41 with the underside (unnumbered) of the flight bar end portion 37. This construction defines in effect a bayonet-type clip into the recess 41 of which may be inserted any one of a plurality of laterally directed flanges 42 integrally formed or joined to links (unnumbered) of the chain 20.

Figure 16:
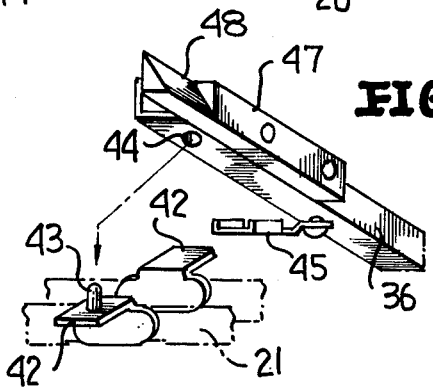
FIG. 16 is a perspective view of the left-hand side of FIG. 14, and in addition to the clamp illustrates an upstanding post for receipt in an aperture of the flight bar for aligning purposes.
Figure 17:
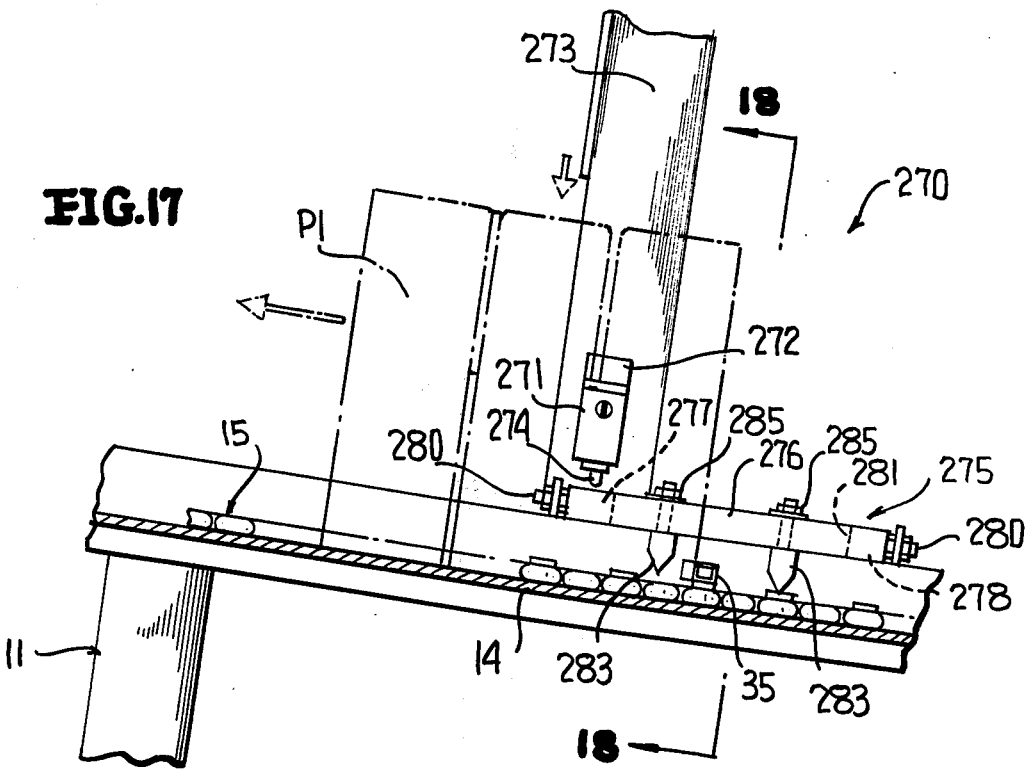
FIG. 17 is a sectional view taken generally along line 17–17 of FIG. 4, and illustrates a pair of depending fingers carried by a pivotally mounted arm for actuating a switch for controlling the operation of the front feed mechanism.

The endless chain 21 also includes laterally projecting flanges 42 with the outboard flanges 42 carrying upright aligning posts or pins 43 receivable in bores 44 of each flight bar end portion 36 in the manner best visualized from FIG. 16 of the drawings. When thus united a generally U-shaped upwardly facing clamp 45 is swung into underlying relationship to the inwardly directed flange 42 and is tightened by rotating a quarter-turn locking screw 46. In this manner each flight bar 35 can be rapidly secured to the chains 20, 21 removed therefrom, and/or repositioned along the length of the chains 20, 21 in and opposite to the machine direction. Preferably though not necessarily, the flanges 42 are spaced from each other at 3 inch increments along each of the chains 20, 21 to permit the flight bars 35 to be spaced from each other anywhere from 9 to 27 inches to accommodate partitions P1 of different lengths. In addition, the end portion 36 of each flight bar 35 carries a member 47 having a cam surface 48 which initiates the operation of the feeding of the partitions P1 in a manner to be described hereinafter.

The partitions P1 are fed to the conveyor 15 by side feed means or stations 51, 52 and 53 (FIGS. 1 and 2) which are of identical constructions and therefore for the purpose of this description only the side feed means 51 will be described in detail since the description thereof is equally applicable to feed means 52 and 53.

Figure 5:
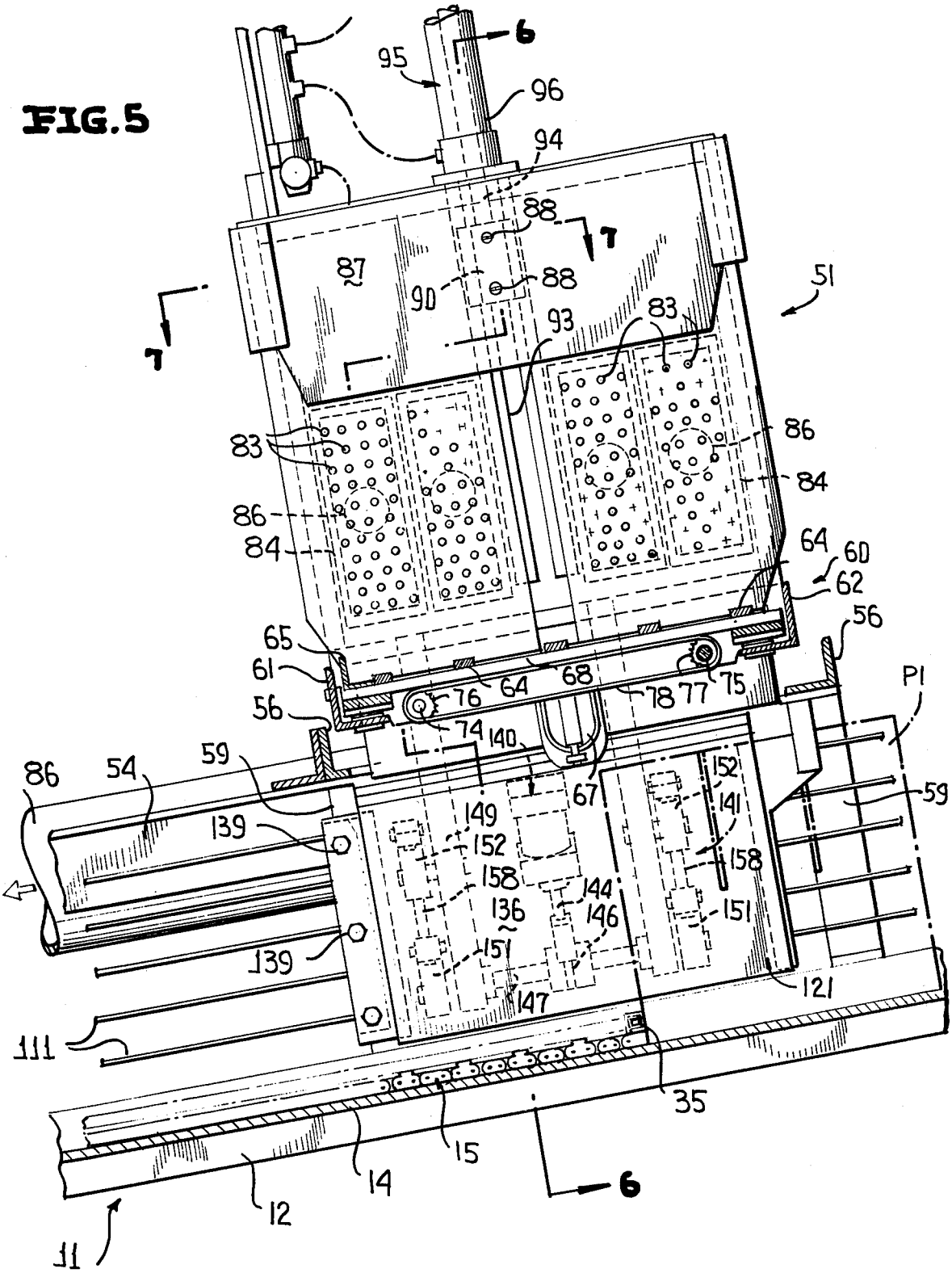
FIG. 5 is a sectional view taken generally along line 5—5 of FIG. 6, and illustrates one of the side feed mechanisms, the shuttle thereof, and means for adjusting the gate of the hopper through which partition pieces are fed to the shuttle.

Referring particularly to FIGS. 5 and 6 of the drawings, the feed means 51 is supported above the upper run of the conveyor 15 and the underlying plate 14 by a superstructure composed of a plurality of angle bar uprights 59 welded to the rails 12, 13, longitudinally extending rails 54, 55 in generally spaced parallel relationship to the rails 12, 13, respectively, and a plurality of transverse angle bars 56 welded atop the flanges (unnumbered) of the rails 54, 55. It is within an adjacent pair of the angles 56, 56 that the feed means 51 is positioned and supported by appropriate brackets, bars, braces, welds, etc., none of which constitute a part of this invention except for the conventionality of supporting the feed means 51 above the conveyor 15.

The feed means 51 includes a hopper or hopper means 60 defined by a pair of side angle bars 61, 62 which internally support therebetween a partition platform 63 having a plurality of support rails 64 disposed in generally spaced parallel relationship, and at an acute angle to the horizontal. It is atop the support rails 64 that the partitions P1 are supported on edge during a feeding operation with left edges (as viewed in FIG. 5) of the partitions P1 being held in alignment by contacting an inner face 65 of an angle bar rail 66 of the platform 63. Due to the position of the rail 66 and the inclination of the frame 11 and the support rails 64, the partitions are maintained in perfect alignment during the movement thereof along the rails 64 of the feed means 51.

Figure 10:
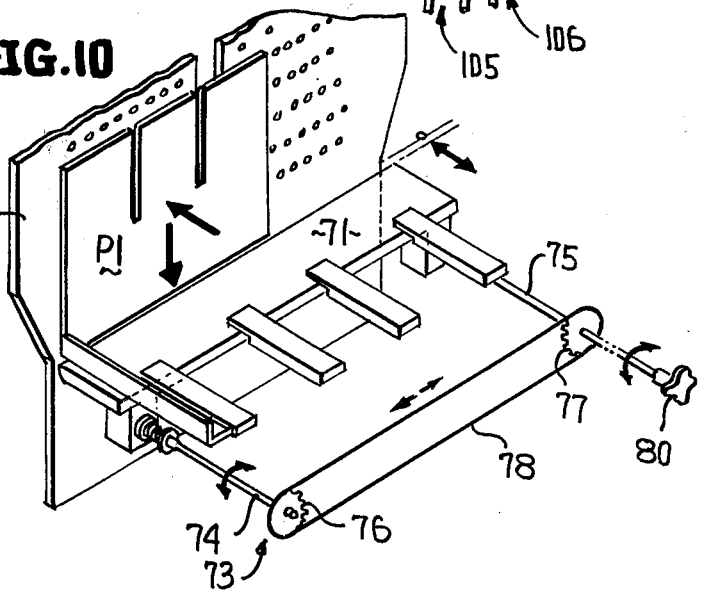
FIG. 10 is a fragmentary perspective view of the hopper with parts broken away for clarity, and illustrates the manner in which the gate adjusting mechanism is operative to adjust the size of the gate.

The partitions P1 are fed downwardly and to the left, as viewed in FIG. 6, by gravity which may, if desired, be augmented by a conventional vibrator 67 secured to the underside of the platform 63. Thus, the forwardmost or leftmost partition P1 is fed to a position adjacent a gate or throat 68 defined by a space between an upstanding back-up plate 70 and a movable plate 71. The movable plate 71 has its opposite transverse edges (unnumbered) received in slots 72 of the rails 61, 62. Means for adjustably moving the movable plate 71 in the slots 72 is generally designated by the reference numeral 73, and includes a pair of shafts 74, 75 (FIGS. 5, 6 and 10) each journalled for rotation in a conventional manner beneath the platform 63. The shaft 74 is appreciably shorter than the shaft 75 but both include respective sprockets 76, 77 about which is entrained a chain 78. Rotation imparted to the shaft 75 through a handle 80 (FIG. 6) will thus be operative to rotate the shaft 74 through the drive of the sprockets 76, 77 and the chain 78 entrained thereabout.

Opposite ends (unnumbered) of the shafts 74, 75 are received in threaded bores 81 of a pair of members 82 welded to the underside of the movable plate 71. Due to this connection, rotation of the handle 80 and the shaft 75 with corresponding rotation of the shaft 74 permits the movement of the movable plate 71 toward or away from the back-up plate 70 to vary the size of the throat 68 depending, of course, upon the thickness of the partitions P1 which are to be fed by the feed means 51 through 53.

The back-up plate 70 is conventionally rigidly supported to define with the rails 64 an angle of approximately 90 degrees and includes a plurality of apertures 83 through which air may be drawn by a plurality of manifolds 84 conventionally secured to the rear of the plate 70 and placed in fluid communication with a vacuum source 85 (FIG. 1) by a conduit means 86. Since the partitions P1 are constructed from paperstock material any bend or warp will be flattened by the creation of a partial vacuum through the apertures 83 thus assuring that each thus flattened partition P1 will be accurately fed downwardly through the throat 68 to thus preclude jamming during a feeding operation.

Each partition P1 is fed downwardly by a striker plate 87 (FIGS. 5 through 7) secured by a pair of bolts 88 to a carrying member 90 having a reduced neck portion 91 and a head 92 which rides in an elongated slot 93 of the back-up plate 70. The carrying member 90 is secured to a piston rod 94 of a double acting fluid motor 95 whose cylinder 96 is conventionally secured atop a bar 97 (FIG. 6) spanning and secured atop the back-up plate 70. As the piston rod 94 moves downwardly, as viewed in FIG. 6, the striker plate 87 engages an upper edge of the leftmost partition P1 and drives the same downwardly through the throat 68. Opposite motion imparted to the piston rod 94 retracts the striker plate 87 for its next feed stroke with the movement of the striker plate 87 being controlled in a manner which will be described more fully hereinafter.

Figure 4:
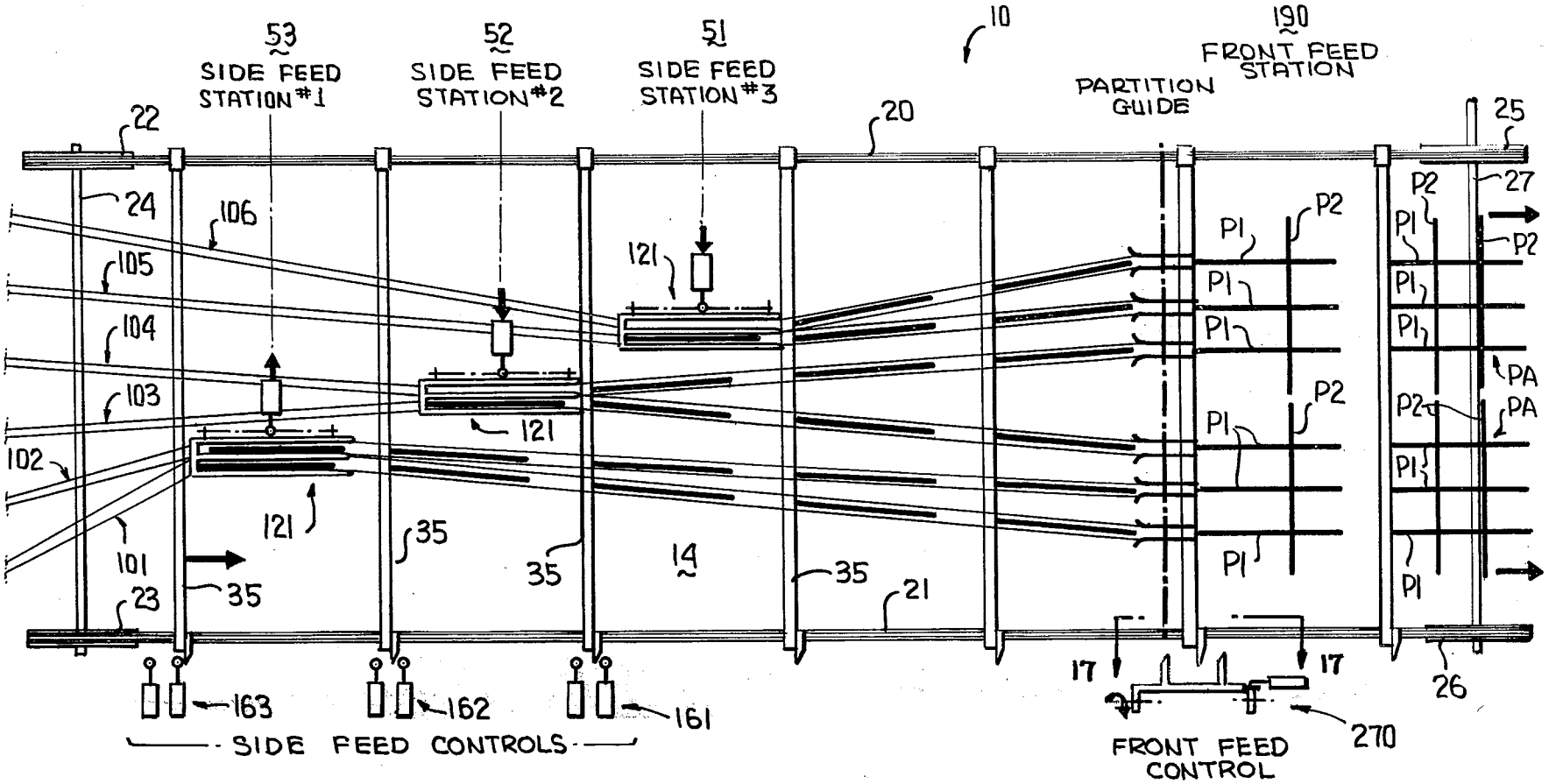
FIG. 4 is a schematic top plan view of the conveyor and guide means, and schematically illustrates the manner in which a shuttle associated with each side feed mechanism is operated in response to conveyor-actuated controls, as is the front feed mechanism.

Reference is now made to FIG. 4 which schematically illustrates the manner in which the partitions P1 are fed into a plurality of guide means 101 through 106 extending between support means 107, 108 (FIG. 1) adjacent respective entrance and exit end portions 16, 17 of the machine 10. Two guide means 101, 102; 103, 104; and 105, 106 are associated with the respective feed means 53, 52 and 51 in such a manner that during the operation of the feed means 51, for example, a partition P1 from the hopper 60 will be fed into the guide means 105 and into the guide means 106 in a manner which will be described more fully hereinafter.

Considering the guide means 105, 106 as being exemplary, the guide means 105 are defined by ten steel cables 110 (FIG. 6) arranged in two pairs of five each inclined to the horizontal. Like cables 111 define the guide means 106. Each cable 110, 111 is secured at its left end, as viewed in FIG. 1, to the support means 107 by a spring 112 while at its right end each cable 110, 111 is conventionally secured to the support means 108 in the manner best illustrated in FIG. 22. In this manner after each partition P1 passes through the throat 68 (FIG. 6), it is positioned between the cables 110 or 111 with its bottom edge resting upon the support plate 14 and is thus supported by the cables 110, 111 of the guide means 105, 106 during the movement thereof from the respective feed means 51, 52, 53 downstream toward the exit end portion 17 of the machine 10.

As was heretofore noted, each feed means 51, 52, 53 feeds partitions P1 to two of the guide means and in order to do so the guide means are shifted transversely of the direction of movement of the conveyor means 15 by shifting means 121 associated with each feed means 51 through 53 positioned between each throat 68 and the conveying means 15. Since the shifting means 121 associated with the feed means 51 is exemplary of identical shifting means associated with the feed means 52, 53, the same will be described hereinafter with reference particularly to FIG. 5 through 9 and 11 of the drawings.

Figure 8:
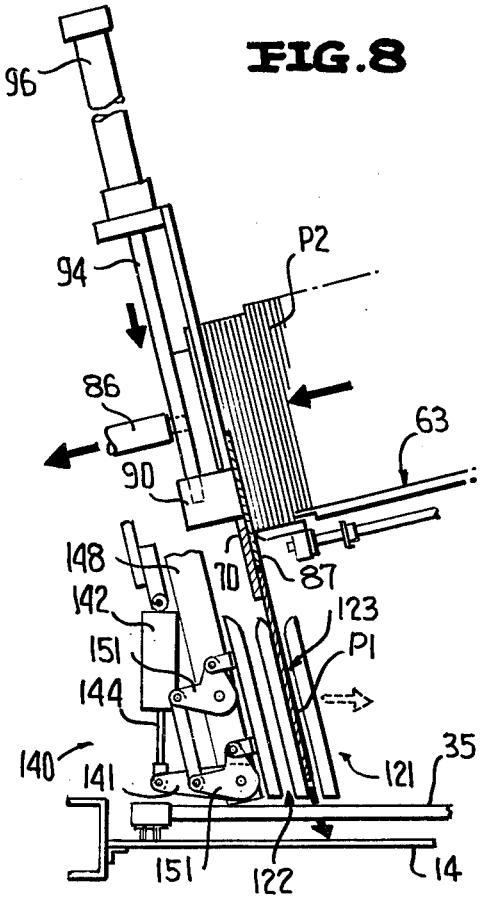
FIG. 8 is a fragmentary schematic side view of the feed mechanism of FIGS. 5 through 7, and illustrates the manner in which a partition piece has been fed into one channel of the shuttle.
Figure 11:
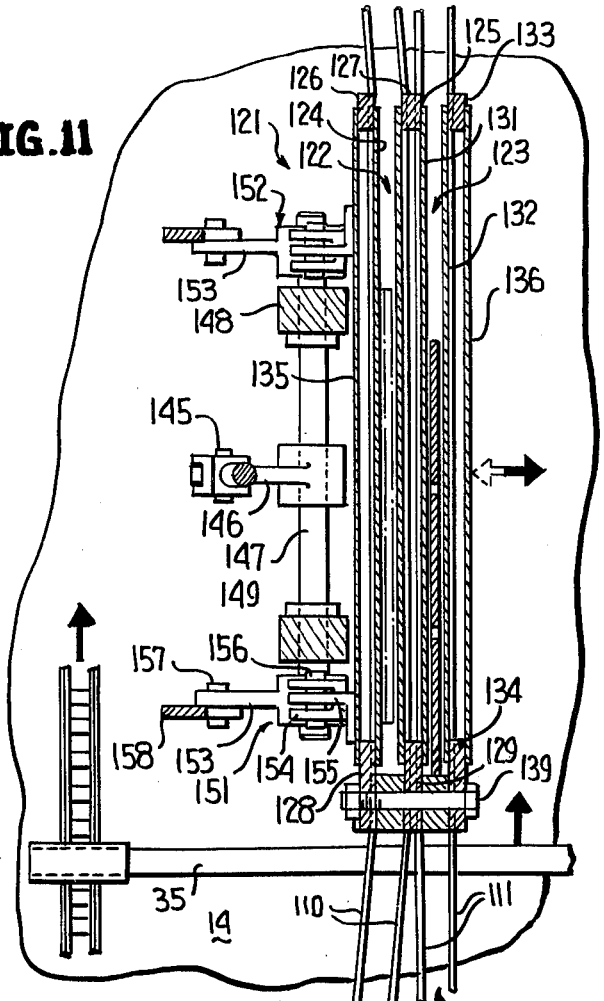
FIG. 11 is an enlarged fragmentary sectional view taken generally along line 11—11 of FIG. 6, and illustrates details of the linkage mechanism for shifting the shuttle.
Figure 9:
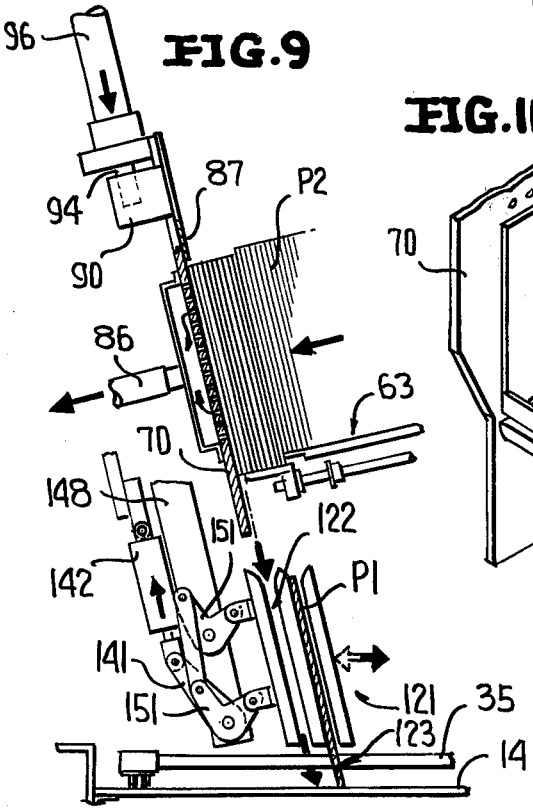
FIG. 9 is a view similar to FIG. 8, and illustrates the shuttle shifted to the right through a linkage mechanism operated by a fluid motor enabling another partition piece from the same hopper to be fed into a second channel of the shuttle.

The shifting means 121 includes a pair of channels 122, 123 into which the partitions P1 are fed depending, of course, upon which of the channels 122, 123 is in alignment with the throat 68. The channel 122 is formed between a pair of inner plates 124, 125 which are welded, bolted or otherwise secured at opposite ends to respective frame members 126, 127 and 128, 129. The channel 123 is likewise defined by a pair of inner plates 131, 132 respectively secured to the support elements 127, 129 and another pair of support elements 133, 134. The support elements 128, 129 and 134 are secured to each other by a plurality of nuts and bolts 139 (FIGS. 5 and 11). The support elements 126, 127 and 133 are secured to each other by an upper bridging piece (not shown) by being welded thereto. A pair of outer plates 135, 136 span and are secured to the support elements 126, 128 and 133, 134, respectively. The support elements 126, 127, 133, 128, 129 and 134 are provided with a plurality of grooves (unnumbered) corresponding to and receiving therethrough the cables 110, 111 of the guide means 105, 106, respectively. There are five such grooves formed in the support elements 126, 128, 133, 134 to accommodate the cables whereas the support elements 127, 129 have ten grooves (five on each side) to accommodate the cables 110, 111. Due to this construction the channels 122, 123 are in effect portions of the guide means 105, 106 which are shiftable transversely to permit a partition P1 to be fed thereinto when in the positions shown in FIGS. 8 and 9. In FIG. 8 the shifting means 121 is illustrated in its right-handmost position at which point the channel 123 and, of course, the cables 111 of the guide means 106 are in alignment with the throat 68 to receive a partition P1 therein. In FIG. 9 the channel 122 has been shifted to the right and is now, along with its cables 110, 110 of the guide means 105, in alignment with the throat 68 to receive a second partition therein from the same feed means 51. In this manner during each cycle of the feed means 51, a partition P1 is fed into the channels 122, 123.

Referring now particularly to FIGS. 5, 6, 8, 9 and 11 of the drawings, the shifting means or shuttle 121 is shifted transversely of the direction of movement of the conveyor 15 in the manner heretofore described by means of a fluid motor 140 operating through a linkage mechanism 141. The fluid motor 140 includes a cylinder 142 supported by a pivot pin 143 in a conventional manner to a portion (unnumbered) of the framework of the feed means 51. A piston rod 144 is pivotally connected by a pivot pin 145 (FIG. 11) to a crank arm 146 which is keyed or otherwise secured to a shaft 147. The shaft 147 is journalled for oscillation in bores (unnumbered) of a pair of support arms 148, 149 (FIG. 11) depending from and forming a portion of the stationary frame or support system of the feed means 51. Bellcrank arms or levers 151, 152 are secured to opposite ends of the shaft 147 and each includes a first arm 153 and a second bifurcated arm 154 within which is received and pivotally connected thereto an arm of a bracket 155 by means of a pivot pin 156. The other arm of each of the two brackets 155 is welded or otherwise secured to the plate 135 of the shuttle 121. Each arm 153 is joined by a pivot pin 157 to an upstanding rod 158 whose upper end is likewise secured to additional crank arms 151, 152 (FIG. 6) identical to the first described crank arms 151, 152 but disposed thereabove. The second mentioned or upper crank arms 151, 152 are likewise pivotally mounted for rotation upon a shaft 147 journalled in the depending support arms 148, 149, and the corresponding arms 154 thereof are secured to an upper portion of the plate 135 by brackets corresponding to the brackets 155.

Assuming that the shuttle 121 is in the position shown in FIG. 8 with the channel 123 in alignment with the throat 68, a partition is fed therein as indicated by the unnumbered solid headed arrow associated therewith by the descent of the striker plate 87. Thereafter the fluid motor 140 is energized to retract the piston rod 144 whereupon the crank arm 146 of the linkage mechanism 141 rotates the lower shaft 147 clockwise which in turn rotates the lower crank arms 151, 152 clockwise, as viewed in FIG. 9. The rods 158 transfer this same motion to the upper crank arms 151, 152, and the four crank arms 151, 151, 152 and 152 thus shift the shuttle 121 to the right from the position shown in FIG. 8 to that shown in FIG. 9. Thereafter the striker plate 87 upon its next descent feeds another partition through the throat 68 and into the channel 122 for subsequent feed along the guide means 105 associated therewith by the movement of the conveyor 15 and more particularly the action of the flight bars 35.

Referring now to FIG. 4 of the drawings, schematically illustrated are shuttles 121 associated with each of the feed means 51 through 53. Since two partitions are fed by each feed means, the eventual total number of partitions fed from left to right by the conveyor 15 is six partitions per flight bar, as indicated by the flight bars downstream from the last feed station 51. At this point one partition is received in each of the guide means 101 through 106 with three of the partitions in the guide means 101 through 103 being eventually formed into a single partition assembly whereas the remaining three partitions in the guide means 104 through 106 eventually are formed into another partition assembly. The number of partitions per complete partition assembly is, of course, optional and may be varied as desired without departing from the scope of this invention.

Switch means 161, 162 and 163 (FIGS. 4, 6, 12 and 13) are associated with the respective means 51, 52, 53 for synchronizing the operation of the striker plate 87 during its feed stroke as well as the operation of the fluid motor 140 to shift the shuttles 121. Each switch means 161, 162 and 163 is identical and includes inverted generally J-shaped brackets 164 (FIG. 13) slidably supported upon a horizontally extending rail 165. The bracket 164 may be clamped in a desired position along the rail 165 by a hand screw 166 in the manner readily apparent from FIG. 13. Each switch means 161 – 163 further includes a conventional solenoid switch 167 carried by the bracket 164 having a pivotally mounted arm 168 carrying a roller 170 in alignment with the cam means 48 of the flight bars 35. Thus as each flight bar moves from left-to-right as viewed in FIG. 12, it will successively operate the switch arms 168 of the switch means 163, 162 and 161.

In addition to providing the hand screws or bolts 166 for adjusting the switches individually, each of the switch means 161, 162 and 163 can be adjusted in unison by means generally designated by the reference numeral 175 which is operative for shifting the rail 165 in the direction of conveyor travel either upstream or downstream.

Figure 12:
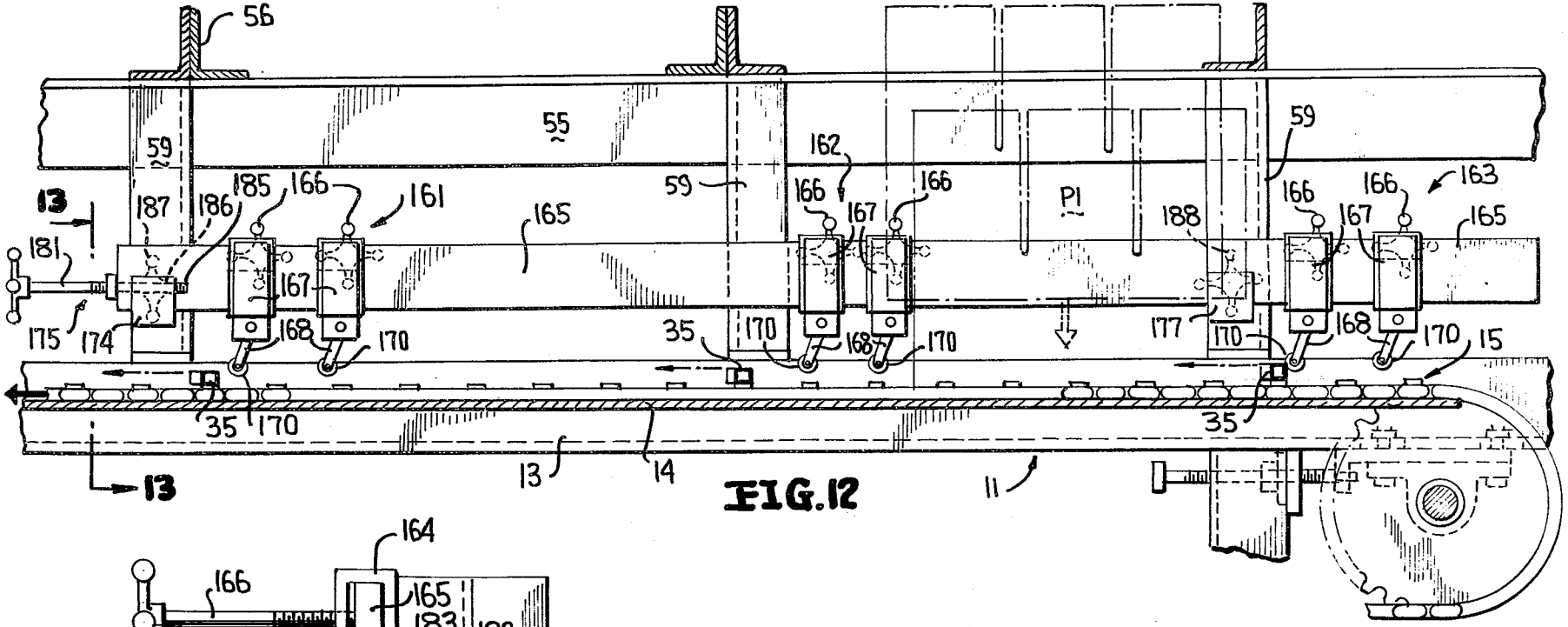
FIG. 12 is a sectional view taken generally along line 12—12 of FIG. 6, and illustrates a pair of switches associated with each side feed mechanism which are actuated by pushers or flight bars of the conveyor in response to which the respective side feed mechanisms are operative to feed partition pieces to the conveyor.

The adjusting means 175 includes a pair of generally L-shaped brackets 176, 177 secured by bolts 178 to the leftmost and rightmost uprights 59 in FIG. 12. A lower edge (unnumbered) of the rail 165 rests upon a surface 180 of each of the L-shaped brackets 176, 177 and may slide therealong to the left or to the right as viewed in FIG. 12. A hand bolt 181 freely rotates in a bore 182 of a plate 183 secured by bolts 184 to an end face (unnumbered) of the rail 165. The hand bolt 183 revolves in the bore 182 but cannot move axially relative thereto because of shoulders, split rings or similar restraining means at either side of the plate 183. A threaded end portion 185 of the hand bolt 181 is received in a threaded bore 186 of an upstanding arm (unnumbered) of the L-shaped bracket 176. Thus as the hand bolt 181 is rotated, the threaded end portion 185 will move axially in the threaded bore 186 to the left or to the right depending upon the direction of rotation of the hand bolt 181 to thereby shift the rail 165 to the right or to the left, as may be desired, to shift the switch means 161, 162 and 163 in unison. Once a desired position has been achieved, hand bolts 187, 188 (FIGS. 13 and 12 respectively) threaded in the uprights 59 are rotated counterclockwise as viewed in FIG. 12 to clamp the rail 165 between the bolts 187, 188 and the associated upstanding arms (unnumbered) of the respective L-shaped brackets 176, 177.

Figures 2, 3:
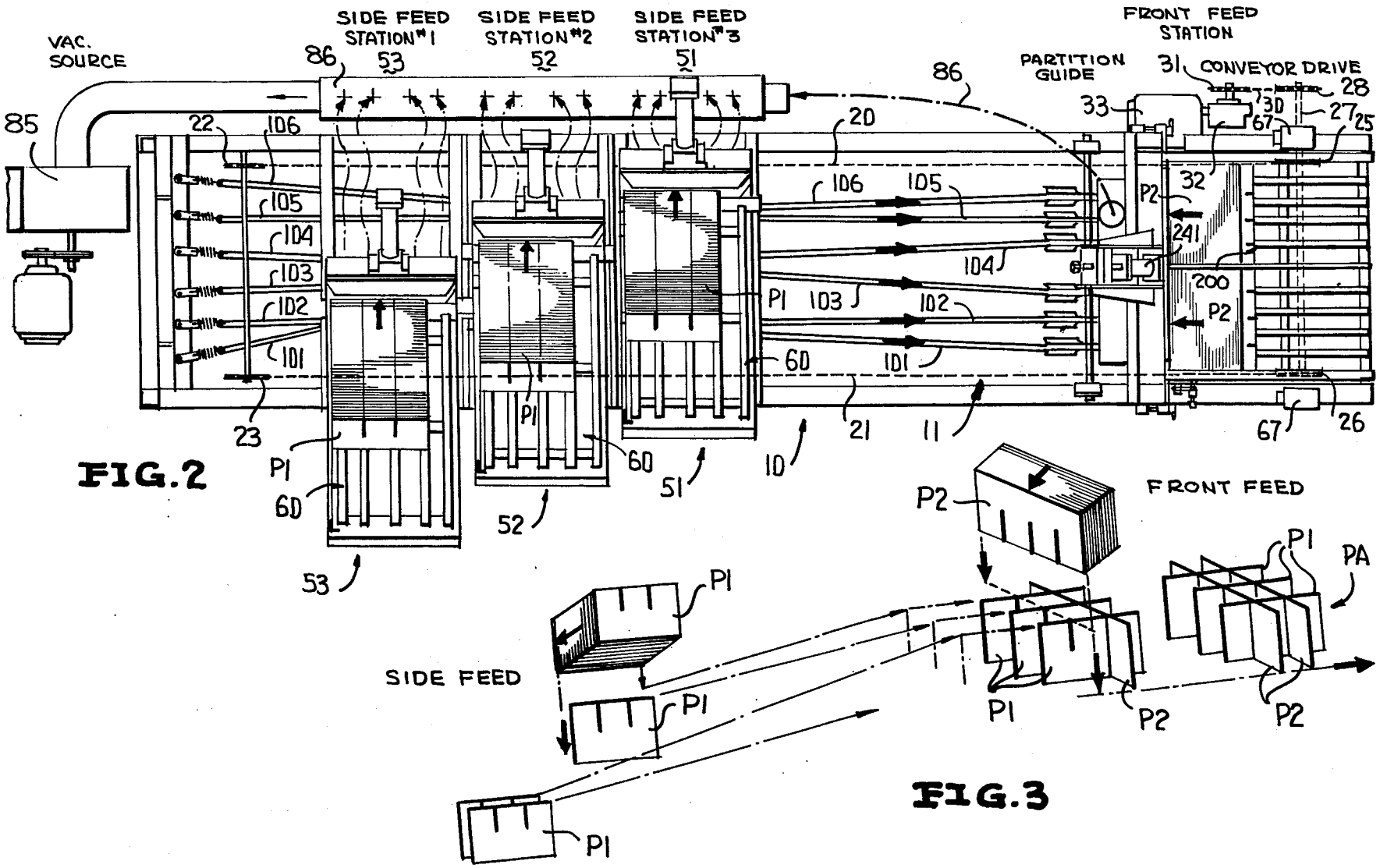
FIG. 2 is a top plan view of the machine, and illustrates the manner in which the partition pieces are fed to the front feed mechanism in two groups of three each from which are formed two partitions.
FIG. 3 is a schematic view illustrating the manner in which one partition piece from the second side feed mechanism is directed to two different partitions during assembly thereof.

A complete partition assembly PA (FIGS. 3 and 4) is formed by feeding two partitions P2 in crossed relationship to each of the two groups of three partitions P1, as schematically illustrated in the latter noted figures. The cross feeding of the partitions P2 is accomplished by a front feed means or front feed station 190 best illustrated in FIGS. 22, 23 to which attention is now directed. The front or cross feed means 190 is supported for vertical movement upon a pair of posts 191, 192 of the frame 11 bridged by a crossbar 193. An upper support bar 194 and a lower support bar 195 have ends which partially embrace the posts 191, 192, as is best illustrated in FIG. 3, relative to the embraced relationship of the post 192 by the end of the arm 195. A conventional threaded clamp 196 is associated with each end of the arms 194, 195 to positively secure the same to the posts 191, 192 in any position of vertical adjustment found necessary or desirable due to the particular height of the partitions P1 and/or P2 involved.

Hopper means generally designated by the reference numeral 200 support the partitions P2 on edge and is formed by a number of transverse supports 201 supported at opposite sides of the conveyor 15 by uprights 202 of the frame 11. A number of guide rails 203 are welded or otherwise secured to the transverse supports 201 and function to guide the partitions P2 during the movement thereof toward a back plate 204 subsequent to the feeding of each partition P2 through a throat 205. In order to rigidify the hopper 200 several of the transverse supports 201 are secured to the underside of two angle bars 206, 207 which are in turn supported by braces 208, 209 conventionally secured to the upper support 194.

Figures 20, 21:
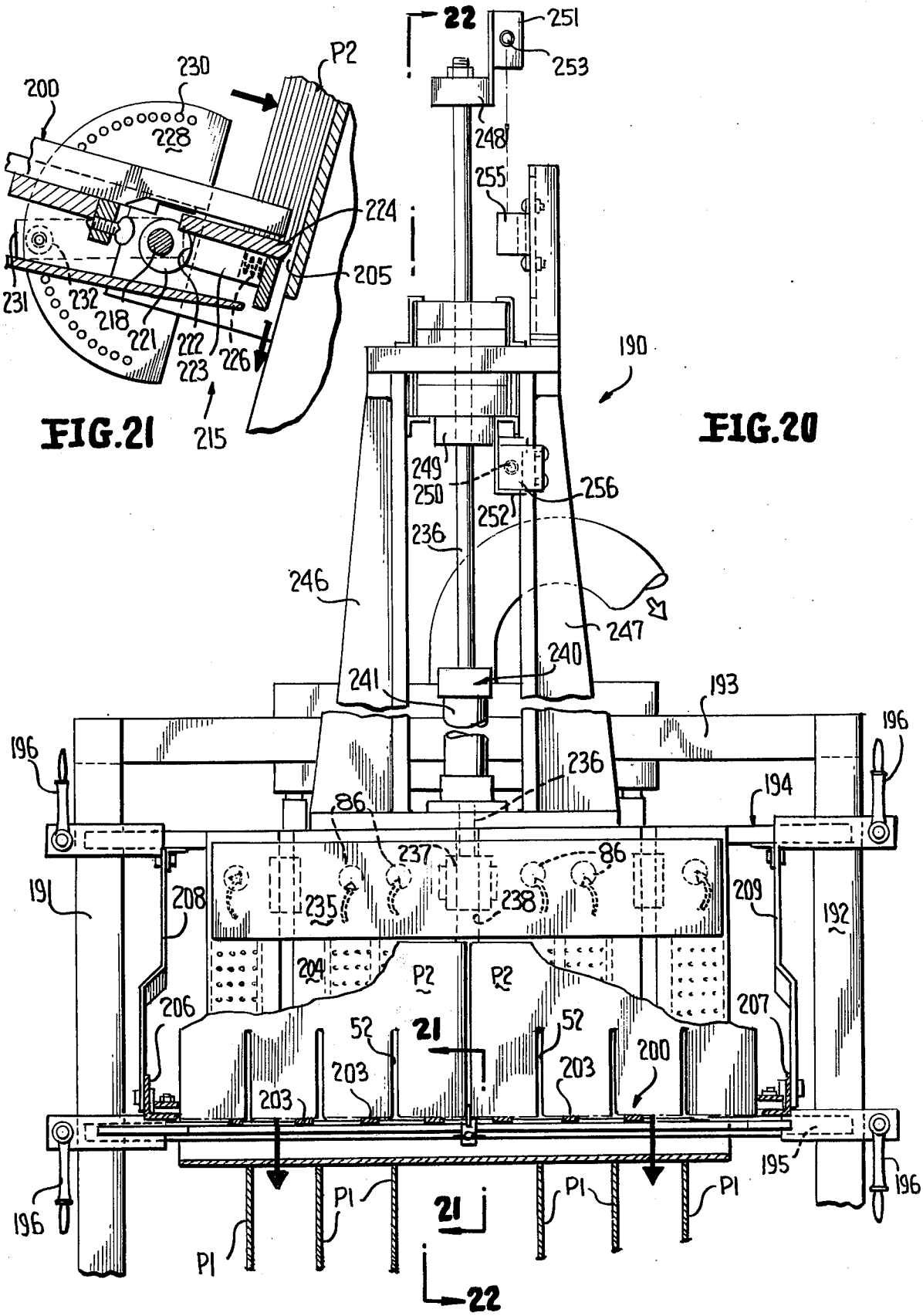
FIG. 20 is a front view of the front or cross feed mechanism with portions thereof shown in section for clarity, and illustrates the manner in which two partition pieces are fed simultaneously for assembly with partition pieces earlier fed to the conveyor by the side feed mechanisms.
FIG. 21 is an enlarged fragmentary sectional view taken generally along line 21—21 of FIG. 20, and illustrates means for adjusting the gate or throat of the front feed mechanism.

As in the case of the feed means 51 through 53, the cross feed means 190 is designed to feed partitions P2 of different thicknesses and thus the gate or throat 205 is selectively adjustable to different sizes by an adjusting mechanism generally designated by the reference numeral 215 (FIGS. 21 and 23). The adjusting mechanism 215 includes a pair of brackets 216 adjacent each of the posts 191, 192 with an upstanding flange 217 being secured to its respective post 191, 192 in a conventional manner. A rotatable shaft 218 is received in bores (unnumbered) of another upstanding flange 220 of each bracket 216. Likewise, an eccentric 221 is keyed or otherwise secured to opposite ends of the shaft 218 inboard of the adjacent brackets 216 with each eccentric 221 bearing against an end face 222 of a bar 223 carrying on its upper surface a plate 224 which with the back-up plate 204 defines the gate or throat 205. The bar is mounted for sliding movement on a lower horizontal flange 225 of each bracket 216 and opposite ends thereof are biased to the right, as viewed in FIG. 23, by springs 226.

The end of the shaft 218 which is not illustrated in FIG. 23 is retained in a conventional manner in the unillustrated flange 220 of the unillustrated bracket 216. However, the illustrated end of the shaft 218 in FIG. 23 passes through a generally semicircular plate 228 welded to the flange 220 of the bracket 216 and having a plurality of openings 230 spaced about its periphery. An arm 231 is keyed to the shaft 218 and carries a manually retractable plunger 232 which is normally biased by a spring (not shown) such that its end (unnumbered) will normally be biased toward the plate 228. Upon manually retracting the plunger 232 and rotating the arm 231 in either direction, the shaft 218 will likewise be rotated whereupon the eccentrics 221 operating against the face 222 of the plate 223 will move the same to the left or right, as appropriate, in FIG. 23 to respectively close or open the throat 205. Upon release of the plunger 232 its end will be received in one of the apertures 230 to lock the plate 224 in a desired position thereby permanently establishing the size of the throat 205.

The partitions P2 are fed downwardly, as is best viewed in FIG. 22, by means of a striker plate 235 secured at its midline to a piston rod 236 by a holding element 237 which passes through a vertical slot 238 of the back plate 204. The piston rod 236 is a portion of a fluid motor 240 which includes a cylinder 241 supported at its lower end upon the upper support arm 194 (FIG. 20). The fluid motor 240 is of the double acting type and the piston rod 236 projects upwardly through the cylinder 241 and passes through annular resilient elastomeric buffers or shock absorbers 243, 244 (FIG. 22) secured to a plate 245 which is in turn secured in spanning relationship to a pair of uprights 246, 247 mounted atop the upper support 194. The buffers 243, 244 contact respective stops 248, 249 secured to the piston rod 236 during the reciprocation of the piston rod and thus absorb undesirable shock and/or vibration. The stops 248, 249 in turn carry respective switches 251, 252 having respective switch arms 253, 254 aligned for contacting respective cams 255, 256. The switches 251, 252 control the operation of the fluid motor 240 through appropriate solenoid operated valves in a manner to be described more fully hereinafter.

As in the case of the feed means 51 through 53, the feed means 190 also includes a number of manifolds 260 in part defined by the back-up plate 204 which includes a plurality of apertures or openings 261. The manifolds 260 are placed in fluid communication with the vacuum source 85 (FIG. 1) by the conduit means 86.

Similarly, as in the case of the feed means 51 through 53, the feed means 190 has associated therewith switch or control means 270 (FIGS. 18 and 19) for controlling the operation of the fluid motor 240 and thus the feeding of the partitions P2. The switch means 270 includes a switch 271 secured to a bracket 272 which is in turn secured to an upright 273 forming a portion of the frame 11. The switch 271 includes a switch arm 274 in generally overlying relationship to an arm 275 of a generally U-shaped configuration formed by a bight portion 276 and a pair of arms 277, 278. The arms 277, 278 are mounted for pivotal movement by appropriate pivot means 280 to permit the arm 275 to be pivoted between the solid and phantom outline positions shown in FIG. 18. The bight portion 276 of the arm 275 includes an elongated slot 281 through which pass threaded studs 282 of a pair of depending fingers 283 having tapered noses 284 in alignment with the cam surfaces 48 carried by the flight bars 35 of the conveyor 15. Appropriate nuts 285 secure each finger 283 at any selected location along the slot 281 to thereby vary the precise time the switch arm 274 may be actuated by the upward pivoting movement of the arm 275 from the solid to the phantom outline position shown in FIG. 18.

OPERATION

Prior to the operation of the machine 10, an operator must first determine precisely the type of final partition assembly PA which is to be formed by unifying the partitions P1 and P2. In the exemplary embodiment of the invention it will be assumed that the eventual partition assembly PA which is to be formed will be composed of three partitions P1 and two partitions P2 with two such partition assemblies PA being formed simultaneously in the manner best diagrammatically illustrated in FIG. 4. It will be assumed for purposes of this discussion that the machine has been synchronized and such details as the gap of the throats 68, 205, the location of the switch means 161 through 163 and 283, the degree of vacuum as established by the speed of the vacuum motor 85, etc., has been attended to. The operator thereafter merely places the partitions P1 in the hopper 63 with slits S1 thereof directed upwardly and with the leftmost edges, as viewed in FIG. 5, against the surface 65 of the rail 66 to assure accurate alignment during the feeding operation. Likewise, partitions P2 with their slots S2 directed downwardly are placed in the hopper 200 of the feed means 190. Absent energization of the vibrators 67, the partitions P1 and P2 will be fed by gravity in the manner indicated by the headed arrows associated therewith in FIG. 2 toward the respective back plates 70, 204, but if desired the vibrators 67 may be energized simultaneously with the energization of the conveyor drive motor 33 and the drive motor (unnumbered) associated with the vacuum source 85.

Figure 13:
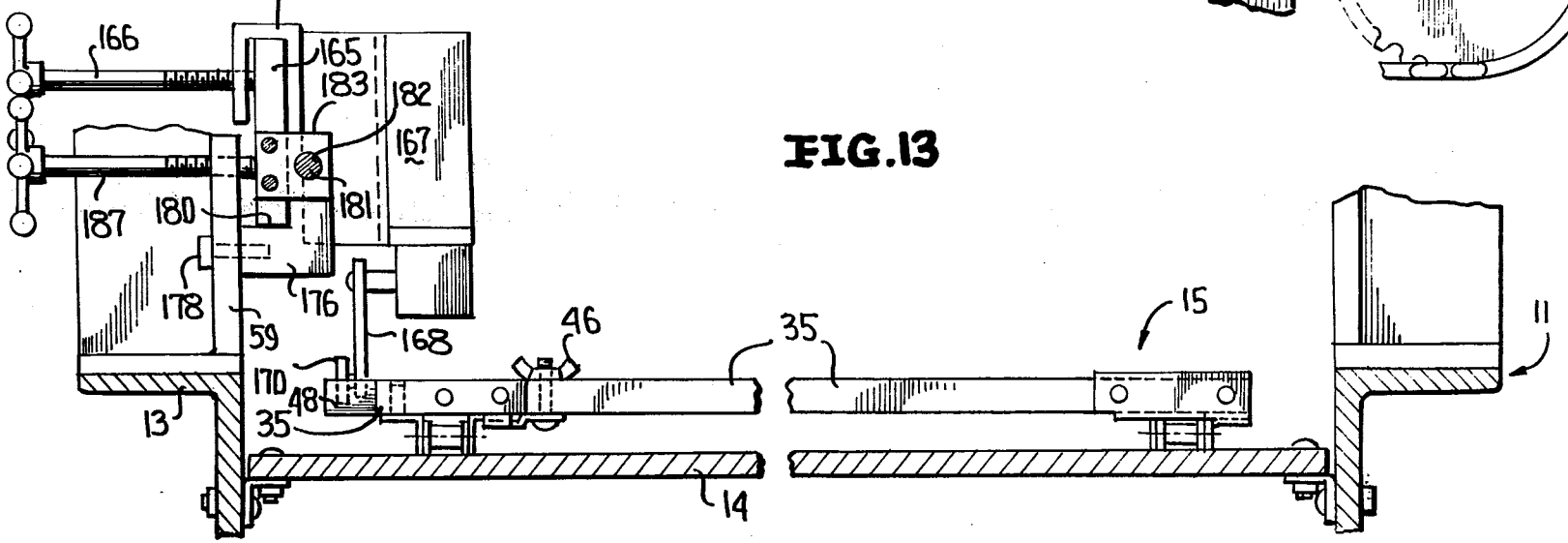
FIG. 13 is a sectional view taken generally along line 13—13 of FIG. 12, and more clearly illustrates the manner in which switch arms of the switches are aligned with the cam means carried by extensions of the flight bars.

As the upper flight of the conveyor 15 moves from the entrance end portion 16 to the exit end portion 17 of the machine 10, the switches 163 through 161 are operated in synchronism whereupon through suitable solenoid valves the piston 94 of each feed means 53-51 is reciprocated once during the operation of each of the two switches 167 as the respective arms 168 are pivoted by the cam surface 48 of the flight bars 35 (FIGS. 12 and 13). Accordingly, a partition P1 is fed into each of the guide means 101 through 106 in the manner herebefore described with the shuttle 121 associated with each of the feed means 53 through 51 being transversely actuated by the operation of the fluid motor 140 in response to the operation of the respective switches 163 through 161.

Upon passing beyond the last feed means or station 51 each of the guide means 101 through 106 includes one partition P1 and thus there are six partitions being moved by each flight bar toward the feed means 190. Prior to the slits S1 of the partitions P1 reaching the throat 205 (FIG. 22) of the feed means 190, the first of the fingers 283 (FIG. 19) is contacted by the cam surface 48 resulting in the operation of the switch 271 and the downward motion of the piston rod 236 upon the actuation of the fluid motor 240. This results in the feeding of one of the partitions P2 downwardly, as is best shown in FIG. 22, with the slits S1, S2 being interengaged. Upon reaching the down stroke of its motion, the fluid motor is reversed by the operation of the switch arm 253 (FIG. 20) by the cam 255. Upward motion is ceased upon the switch 254 being depressed by the cam 256 which in effect resets the feed means 190 for the next feed stroke upon the cam surface 48 contacting the next tapered surface 284 of the succeeding finger 283, as is about to occur in FIG. 19 resulting in the reciprocation of the stroker plate 235 upon downward movement of the piston 236. The final result is the formation of the two partition assemblies PA illustrated at the right-handmost side of FIG. 4.

While preferred forms and arrangements of parts have been shown in illustrating the invention, it is to be clearly understood that various changes in details and arrangement of parts may be made without departing from the spirit and scope of this disclosure.

We claim:

1. A machine for assembling elements in generally crossed relationship comprising a plurality of means for guiding elements along a predetermined path of travel, means for conveying the elements along said path during the guidance thereof by said guiding means, single feed means for feeding elements toward said guiding means, and means for shifting different ones of said guiding means into alignment with elements fed from said single feed means whereby individual elements from said single feed means are disposed in at least two different ones of said guiding means.

2. The machine as defined in claim 1 including other feed means for feeding other elements into transverse relationship to said first-mentioned elements.

3. The machine as defined in claim 1 wherein said shifting means are operative for successively and repetitiously shifting said different guiding means into alignment with successive elements fed from said single feed means.

4. The machine as defined in claim 1 wherein said predetermined path of travel includes entrance and exit end portions generally spanned by said conveying and guiding means, said single feed means is located at said entrance end portion, and said shifting means is effective for shifting said different guiding means transversely of said predetermined path of travel into alignment with elements fed from said single feed means.

5. The machine as defined in claim 1 including means responsive to the movement of said conveying means for initiating the operation of said single feed means.

6. The machine as defined in claim 1 including means supporting said guiding means above said conveying means, and said conveying means include pusher means spaced from each other in the direction of said path of travel and in spanning relationship to said guiding means.

7. The machine as defined in claim 1 including hopper means associated with said feed means for supporting said elements incident to the feeding thereof to said guiding means, said hopper means includes a bottom wall at no more than an acute angle to the horizontal whereby said elements are gravity influenced in a direction toward said feed means, said feed means includes an upstanding wall toward which said elements are gravity influenced, and said upstanding wall is at an obtuse angle to the horizontal whereby said bottom and upstanding walls cooperatively function to maintain said elements in stacked relationship movable under gravity influence toward said upstanding wall.

8. The machine as defined in claim 1 wherein said conveying means include a plurality of spaced endless members, a plurality of spaced flight bars spanning said endless members, and means for quick disconnect coupling said flight bars to said endless members.

9. The machine as defined in claim 1 wherein said conveying means include a plurality of spaced endless members, a plurality of spaced flight bars spanning said endless members, and means for shifting said flight bars relative to each other to vary the spacing therebetween.

10. The machine as defined in claim 1 including other feed means for feeding other elements into transverse relationship to said first-mentioned elements, hopper means associated with said other feed means for supporting said elements incident to the feeding thereof to said guiding means, and said hopper means includes a bottom wall at no more than an acute angle to the horizontal whereby said other elements are gravity influenced in a direction toward said other feed means.

11. The machine as defined in claim 1 wherein said guiding means are a plurality of guide channels positioned between said conveying means and said single feed means, and said shifting means are operative for deflecting said guide channels into alignment with elements fed from said single feed means.

12. The machine as defined in claim 1 including other feed means for feeding other elements into transverse relationship to said first-mentioned elements, and means responsive to the movement of said conveying means for initiating the operation of said single and other feed means.

13. The machine as defined in claim 5 wherein said conveying means includes a plurality of spaced endless members, a plurality of spaced flight bars spanning said endless member, said initiating means includes a switch disposed along one of said endless members, and means carried by said one endless member for operating said switch upon movement of said one endless member.

14. The machine as defined in claim 5 wherein said predetermined path of travel includes entrance and exit end portions generally spanned by said conveying and guiding means, and single feed means is located at said entrance end portion, and said shifting means is effective for shifting said different guiding means transversely of said predetermined path of travel into alignment with elements fed from said single feed means.

15. The machine as defined in claim 7 wherein said predetermined path of travel includes entrance and exit end portions generally spanned by said conveying and guiding means, said single feed means is located at said entrance end portion, snd said shifting means is effective for shifting said different guiding means transversely of said predetermined path of travel into alignment with elements fed from said single feed means.

16. The machine as defined in claim 8 wherein said predetermined path of travel includes entrance and exit end portions generally spanned by said conveying and guiding means, said single feed means is located at said entrance end portion, and said shifting means is effective for shifting said different guiding means transversely of said predetermined path of travel into alignment with elements fed from said single feed means.

17. The machine as defined in claim 9 wherein said predetermined path of travel includes entrance and exit end portions generally spanned by said conveying and guiding means, said single feed means is located at said entrance end portion, and said shifting means is effective for shifting said different guiding means transversely of said predetermined path of travel into alignment with elements fed from said single feed means.

18. The machine as defined in claim 10 wherein said predetermined path of travel includes entrance and exit end portions generally spanned by said conveying and guiding means, said single feed means is located at said entrance end portion, and said shifting means is effective for shifting said different guiding means transversely of said predetermined path of travel into alignment with elements fed from said single feed means.

19. The machine as defined in claim 11 wherein said predetermined path of travel includes entrance and exit end portions generally spanned by said conveying and guiding means, said single feed means is located at said entrance end portions, and said shifting means is effective for shifting said different guiding means transversely of said predetermined path of travel into alignment with elements fed from said single feed means.

20. A machine for assembling elements in generally crossed relationship comprising a plurality of means for guiding elements along a predetermined path of travel, means beneath said guiding means for conveying the elements along said path between entrance and exit ends thereof, means for feeding elements toward said guiding and conveying means, means for shifting different ones of said guiding means into alignment with elements fed from said feed means whereby individual elements from said feed means are disposed in at least two different ones of said guiding means, said feed means is located at said entrance end, said guiding means are a plurality of guide channels, said shifting means are operative for deflecting said guide channels into alignment with elements fed from said feed means, and other feed means at said exit end for feeding other elements into transverse relationship to said first-mentioned elements.

21. The machine as defined in claim 20 including means responsive to the movement of said conveying means for initiating the operation of said single feed means.

22. The machine as defined in claim 20 wherein said conveying means include a plurality of spaced endless members, a plurality of spaced flight bars spanning said endless members, and means for quick disconnect coupling said flight bars to said endless members.

23. The machine as defined in claim 20 wherein said conveying means include a plurality of spaced endless members, a plurality of spaced flight bars spanning said endless members, and means for shifting said flight bars relative to each other to vary the spacing therebetween.

24. The machine as defined in claim 20 including means responsive to the movement of said conveying means for initiating the operation of said single and other feed means.

25. A method of assembling elements in generally crossed relationship comprising the steps of feeding at least two elements in succession along a first path, said elements being fed with a trailing edge of a leading element being followed by a leading edge of a trailing element and said trailing and leading elements being in a uniplanar plane, shifting the leading of the two elements transversely out of the first path, conveying the two elements in unison along a second path in transverse relationship to said first path, feeding a further element along a third path in transverse relationship to said second path, and cross assembling said two and further elements at an intersection of said second and third paths.

26. The method as defined in claim 25 including the step of moving said two elements away from each other during movement thereof along said second path.

27. A machine for assembling elements in generally crossed relationship comprising a plurality of means for guiding elements along a predetermined path of travel, means below said guiding means for conveying the elements along said path between entrance and exit ends thereof, means for feeding elements into said guiding means at said entrance end for movement thereof by said conveying means toward said exit end, other feed means at said exit end for feeding the elements into transverse relationship to said first-mentioned elements, said feed means each having associated therewith a hopper having a bottom wall at no more than an acute angle to the horizontal whereby elements are gravity-influenced in a direction toward said feed means, an upstanding wall toward which said elements are gravity-influenced, each upstanding wall is at an obtuse angle to the horizontal whereby said bottom and upstanding walls cooperatively function to maintain said elements in stacked relationship movable under gravity influenced toward the upstanding wall, and means responsive to the movement of said conveying means for initiating the operation of both said feed means.

28. A machine for assembling elements in generally crossed relationship comprising a plurality of means for guiding elements along a predetermined path of travel, means below said guiding means for conveying the elements along said path between entrance and exit ends thereof, means for feeding elements into said guide means at said entrance end for movement thereof by said conveying means toward said exit end, other feed means at said exit end for feeding the elements into transverse relationship to said first-mentioned elements, said feed means each having associated therewith a hopper having a bottom wall at no more than an acute angle to the horizontal whereby elements are gravity-influenced in a direction toward said feed means, an upstanding wall toward which said elements are gravity-influenced, each upstanding wall is at an obtuse angle to the horizontal whereby said bottom and upstanding walls cooperatively function to maintain said elements in stacked relationship movable under gravity-influence toward the upstanding wall, a feed throat through which said elements are fed by said feed means, and means for adjusting the size of the feed throat for facilitating the passage therethrough of elements of different thicknesses.

* * * * *